United States Patent [19]

Gotchel et al.

[11] 4,130,915

[45] Dec. 26, 1978

[54] CARDING OPERATION FOR FORMING A FIBROUS STRUCTURE

[75] Inventors: Joel P. Gotchel, Glen Mills, Pa.; Henry J. Norton, Wilmington, Del.

[73] Assignee: Scott Paper Company, Philadelphia, Pa.

[21] Appl. No.: 834,709

[22] Filed: Sep. 19, 1977

[51] Int. Cl.[2] ..... D04H 1/00

[52] U.S. Cl. ..... 19/304; 19/101

[58] Field of Search ..... 19/155, 156, 156.3, 19/156.4, 100, 101, 304, 296; 264/90, 109, 115, 116; 156/62.2, 62.4; 425/80, 80.1

[56] References Cited

U.S. PATENT DOCUMENTS

| | | | |
|---|---|---|---|
| 3,051,998 | 9/1962 | Rust, Jr. et al. | 19/156 X |
| 4,064,600 | 12/1977 | Gotchel et al. | 19/156.3 |

*Primary Examiner*—Dorsey Newton

*Attorney, Agent, or Firm*—Martin L. Faigus; William J. Foley

[57] ABSTRACT

This invention relates to a carding process for forming a nonwoven fibrous structure including a blend of short fibers under ¼ inch in length and longer reinforcing fibers. In accordance with the process fibers are separated from a fibrous feed by engaging the feed with projections on the periphery of a main carding drum that is rotating at a surface speed of at least 12,500 feet/-minute. The rotating main drum directs the fibers into a working section in which projections on rotating worker and turner satellite rolls cooperate with the projections on the main drum to individualize the fibers and blend them together. The necessary interaction between the projections of the main drum and the projections of the satellite rolls to both individualize and blend the fibers is achieved by pressurizing the working section to a level that minimizes undesirable air flow characteristics about the satellite rolls. The fibers that are individualized and blended in the working section are directed to a foraminous forming surface in the form of a nonwoven fibrous structure.

13 Claims, 1 Drawing Figure

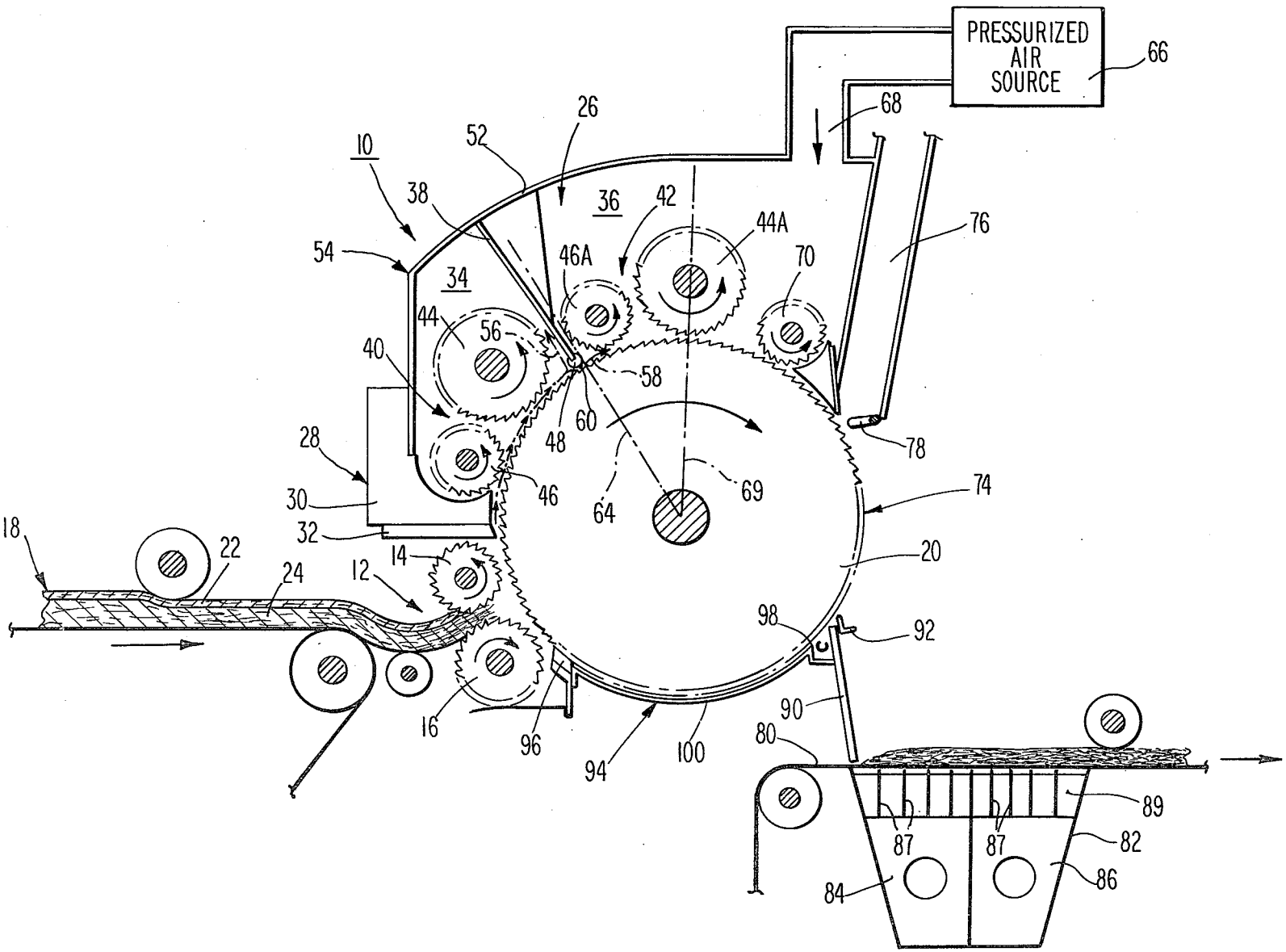
PRESSURIZED AIR SOURCE
66
68
76
78
74
20
92
90
80
98
100
94
96
16
12
14
24
22
18
28
30
32
10
54
38
52
26
36
34
44
56
40
46
48
60
58
64
69
42
46A
44A
70
87
87
89
82
86
84

CARDING OPERATION FOR FORMING A FIBROUS STRUCTURE

BACKGROUND OF THE INVENTION

This invention relates generally to a carding process for forming a nonwoven fibrous structure including a blend of short fibers under ¼ inch in length and longer reinforcing fibers. In particular this invention relates to a carding process employing a main carding drum having projections on its outer periphery for cooperating with projections on rotating worker and turner rolls to separate and blend the fibers.

Dry-formed nonwoven fibrous structures including short fibers less than ¼ inch in length as the predominant fiber component (by weight) and a minor proportion of longer reinforcing fibers are becoming quite popular; especially for limited and single use absorbent applications. For example, in the low basis weight range of less than about 6 ounce/yard$^2$, these nonwoven webs have been employed in the formation of diaper covers, industrial and household wipers, cosmetic pads, liners for underpads and impregnated wipes for personal hygiene usage. At higher basis weight levels the fibrous structures can be employed as an internal absorbent component of sanitary napkins and disposable diapers, or as a feed mat to be directed into a web forming device to form nonwoven webs in the above-mentioned low basis weight range. A representative process employing a feed mat of blended short and long fibers to form such a low basis weight web is disclosed in U.S. Pat. No. 3,862,472, issued to Norton et al, and assigned to Scott Paper Company. This patent is incorporated herein by reference.

In U.S. Patent Application Ser. No. 715,165, filed on Aug. 17, 1976, and assigned to Scott Paper Company, a carding apparatus and method is disclosed for forming a fibrous structure including short fibers less than ¼ inch in length as the predominate fiber component by weight, and longer reinforcing fibers as the minor fiber component by weight. This apparatus and method are most suited for use in forming high basis weight fibrous mats that can be used, for example, as the feed mat to a web former, as disclosed in the above-discussed Norton et al patent. However, this apparatus and method can also be used to form low basis weight fibrous structures less than about 6 ounces/yard$^2$.

When the apparatus disclosed in the 715,165 application is operated with the working section under atmospheric pressure conditions, and with the main drum rotating at a surface speed in excess of 12,500 feet/minute, undesirable counter air flow conditions begin to develop about the satellite rolls. This tends to cause premature launching of the short fibers from the satellite rolls; resulting in the formation of clumps that become part of the formed web structure. Although these clumps are undesirable in many fibrous structures, they are most undesirable in low basis weight structures less than about 6 ounces/yard$^2$. The reason for this is that uniformity of appearance and physical properties is important for many products in which these low basis weight webs are used. The presence of clumps has an adverse effect on both of these desired attributes.

This invention is an improvement over the apparatus and method generically described and claimed in the 715,165 application, and can be employed in forming both low basis weight webs less than 6 ounces/yard$^2$, and higher basis weight feed mats; generally greater than 12 ounces/yard$^2$. In accordance with this invention the greatest advantages are achieved in minimizing the formation of fibrous clumps in low basis weight webs less than about 6 ounces/yard$^2$.

SUMMARY OF THE INVENTION

In accordance with this invention a high-speed carding operation is employed to form a nonwoven fibrous structure at a speed in excess of 400 feet/minute; said structure including, as the predominate fiber component, short fibers under ¼ inch in length, and further including, as the minor fiber component, longer reinforcing fibers greater than ¼ inch in length. Fibers are separated from a fibrous feed including the short and long fibers by engaging the feed with projections on the periphery of a main carding drum rotating at a surface speed of at least 12,500 feet/minute. The rotating main drum directs the fibers into a working section in which projections on rotating worker and turner satellite rolls cooperate with the projections on the main carding drum to further separate, or individualize the fibers and blend them together.

A significant and unique aspect of this invention resides in carrying out the desired fiber separation and blending operations by continuously maintaining a positive pressure in the working section at a level that minimizes undesirable counter air flow about the satellite rolls. This pressure level, in all cases, is greater than 2 inches of water. In the more preferred embodiments of this invention the working section is pressurized to at least 6 inches of water, and most preferably to a level greater than 10 inches of water. In a representative mode of operation in accordance with this invention the main drum is rotated at a surface speed in excess of 15,000 feet/minute, and the pressure established in the working section is approximately 16 inches of water.

Pressurizing the working section, as set forth above, minimizes undesirable air flow conditions about the satellite rolls to permit the desired interaction to take place between the main carding drum and the satellite rolls to both individualize and blend the fibers at high forming speeds. Specifically, pressurizing the working section to the required level prevents undesirable clump formation by preventing premature separation of fibers from the satellite rolls.

After the fibers have been separated and blended in the pressurized working section, they are directed onto a foraminous surface in the form of a nonwoven fibrous structure. Formation of the nonwoven structure is aided by establishing a partial vacuum from beneath the forming surface. In accordance with this invention the fibrous structure can either be a low basis weight (less than about 6 ounce/yard$^2$) fibrous web, or a high basis weight fibrous mat, such as a feed mat of the type described in the earlier referred to Norton et al patent.

Other objects and advantages of this invention will become apparent by referring to the detailed description which follows, taken in conjunction with the drawing.

BRIEF DESCRIPTION OF THE DRAWING

The drawing is a schematic side elevation view of a preferred apparatus for carrying out the carding process of this invention.

DESCRIPTION OF THE PREFERRED EMBODIMENT OF THE INVENTION

In accordance with this invention a high speed carding process is carried out by establishing a positive pressure of at least 2 inches of water in a working section of a carding apparatus employing a rotating main drum and rotating turner and worker satellite rolls. The main drum and satellite rolls have projections on their outer peripheries that cooperate to individualize short fibers under ¼ inch in length and longer reinforcing fibers, and to blend these fibers together.

The present invention has its most significant benefits when forming a low basis weight fibrous web of less than 6 ounces/yards$^2$. However, this invention can also be utilized with advantage in forming heavier basis weight fibrous mats, such as a feed mat of the type described in the earlier-referred-to Norton et al patent.

This invention most preferably is carried out in an apparatus 10 that is very similar in construction to the preferred apparatus disclosed in U.S. Application Ser. No. 715,165. In order to provide a better understanding of the present invention, this apparatus will first be described.

The apparatus 10 has an inlet section 12 that includes opposed under and lower feed rolls 14 and 16, respectively. These feed rolls provide a feeding nip to direct a laminate fibrous feed 18 into engagement with projections of a main carding drum 20.

The laminate feed 18 includes an upper fibrous layer 22 of opened textile-length fibers over ¼ inch in length, and a loosely compacted lower layer 24 of short fibers less than ¼ inch in length. Most preferably the upper feed roll 14 has projections, such as teeth or pins on its outer periphery for engaging the upper layer 22 of textile-length fibers during the feeding operation. As shown in the drawing the upper feed roll 14 includes teeth with a negative rake, (i.e., a slant oppose to the rotational direction of the roll), to provide the most effective gripping and feeding action for the feed. The lower roll 16 is also shown as including projections in the form of teeth on its periphery. However, if desired, this lower feed roll can also be knurled or smooth-surfaced.

In the preferred embodiment of this invention the textile-length fibers employed in the upper layer 22 are either rayon or polyester; however, the specific long fiber component is not considered to be a limitation on the scope of the present invention. The preferred short fiber component is wood pulp because it is readily available, relatively economical and highly absorbent. Absorbency is particularly important when the fibrous structure that is formed is intended to be used for applications requiring the retention of liquids. Other short fibers, such as cotton linters, can also be employed in this invention; the particular short fiber component not being considered a limitation on the broadest aspects of this invention.

The rotating main drum 20 conveys the fibers separated from the laminate feed 18 into a working section 26. As can be seen in the drawing the main drum 20 includes teeth with a positive rake on its outer periphery. That is, the teeth are inclined in the direction of rotation of the drum so that they are oriented to hook the fibers of the laminate feed 18 as the main drum is advanced past the feed rolls 14 and 16.

A feed roll baffle arrangement 28 includes an upper section 30 and a lower section 32 positioned to prevent an excessive quantity of air from being pumped through the inlet section 12 by the high speed rotation of the main drum 20. In addition, this baffle arrangement has surfaces positioned close to the outer periphery of the main drum for maintaining proper control of air that is directed through the inlet section into the working section 26. The baffle arrangement 28 employed in this invention is identical to that described in the 715,165 application, and reference should be had to the 715,165 application for further details.

The working section 26 is identical to that described in the 715,165 application. However, in order to facilitate an understanding of the instant invention a description of this working section will be included herein.

The working section 26 includes fiber working areas 34 and 36 that are separated by a baffle plate 38. These working areas include sets of satellite rolls 40 and 42, respectively, and these satellite rolls cooperate with the main drum 20 to individualize and blend the fibers directed through the working section. The set of satellite rolls 40, which is the first set encountered by fibers directed into the working section 26, includes a worker roll 44 and a turner roll 46. The other set of satellite rolls 42 includes identical worker and turner rolls, designated 44A and 46A respectively. Reference should be made to the 715,165 application for a more detailed discussion relating to the construction of the satellite rolls, their spacing relative to each other and to the main drum 20, and the manner in which they cooperate with the main drum.

The baffle plate 38 preferably is of the same construction as the one disclosed in the 715,165 application; including a lower air directing section 48 that is substantially cylindrical and that extends for the entire cross-machine-direction of the apparatus. The baffle plate is sealed against inner surfaces of an upper wall 52 and the side walls (not shown) of a housing 54 that is positioned over the working section. This housing substantially isolates the working section 26 from the environment around it so that the pressure conditions within the working section can be controlled to insure that the fibers are properly individualized, blended and conveyed through the apparatus. By sealing the baffle plate 38 against the inner walls of the housing the fiber working areas 34 and 36 can be substantially isolated from each other so that their operation will not adversely influence each other.

The cylindrical air directing section 48 preferably is positioned no more than 0.2 inches away from the periphery of the main drum 20, and intercepts the flow of air directed to it by the high speed rotation of said drum. The intercepted flow is split into separate components indicated by arrows 56 and 58, with the volume of air in component 56 being considerably less than the volume in component 58. Diverting air in the general direction of arrow 56 increases the static pressure adjacent the downstream end of the worker roll 44 to thereby reduce the pressure drop from the upstream end of the turner roll 46 to the downstream end of said worker roll. Reducing this pressure drop minimizes the undesirable flow of air in a direction counter to the direction of rotation of fiber flow on said worker and turner rolls (i.e., the direction of rotation of the worker and turner rolls). Minimizing this counter air flow reduces the premature doffing of long and short fibers from the satellite rolls to aid in better processing these fibers through the first fiber working area 34.

The component of air 58 is directed through a constricted area 60 provided between the lower end of the air-directing section 48 and the outer periphery of the main drum 20. This confines the flow of air to the periphery of the main drum 20 so that it will be conveyed between said main drum and the turner roll 46A of the second set of satellite rolls 42. In this manner the flow is prevented from being intercepted by the turner roll 46A, and being deflected counter to the direction of rotation of said turner roll. In order to insure that the component of air indicated by arrow 58 is directed between the periphery of the turner roll 46A and the periphery of the main drum 20, the downstream edge 62 of the air-directing section 48 underlies the turner roll 46A. This downstream edge is considered to underlie the turner roll 46A when a line drawn from the axis of rotation of the main drum 14 tangent to said downstream edge, as indicated in phantom at 64, intercepts the periphery of the turner roll 46A.

In accordance with an extremely important feature of this invention a pressurized air source 66, such as a fan, is connected through conduit 68 to communicate with the interior of the housing 54. This fan is employed to pressurize the working section 26 to a level necessary to minimize undesirable air flow characteristics about the satellite rolls when the carding operation is carried out in accordance with this invention. This minimizes the undesirable formation of clumps or ropes.

Most preferably the pressurizing air is directed through a passageway in the housing between the worker roll 44A and the exit from the working section 26. This insures that the desired pressure level is obtained adjacent the most downstream set of satellite rolls in the working section. The passageway communicating with conduit 68 extends for the entire cross-machine-direction of the apparatus 10, and is located downstream of the intersection, with the top wall 52, of a plane which passes through the axes of rotation of the main drum 20 and the worker roll 44A. This plane is indicated by the phantom line 69.

If desired an additional pressure creating source can be employed to directly communicate with the first fiber working area 34. However, it has been found that the entire working section 26 can be pressurized to the necessary extent by directing the pressurized gas into the housing adjacent the most downstream set of satellite rolls 42, in the manner described above.

The most downstream section of the working section 16 includes a seal roll 70 and a guide plate 72. The seal roll confines the air flow to the periphery of the main drum, and the guide plate accelerates and smooths out this flow as it is directed to a generally vertically oriented fiber release zone 74 on said main drum. The seal roll 70 and guide plate 72 are identical to the seal roll 80 and guide plate 82 described in the 715,165 application, and no further discussion of these elements is believed to be necessary in the instant application.

If desired, pressurized air can be directed through a conduit 76, and deflected by an adjustable flap 78 toward the periphery of the main drum 20 adjacent the lower edge of the guide plate 72. This tends to control the manner in which fibers are released from the periphery of the main drum in release zone 74, and thereby partially controls the path of fiber flow to a forming surface 80. In the embodiment shown, the forming surface 80 is the upper reach of an endless conveyor, and the flow of fibers through the conveyor is aided by establishing a partial vacuum through a vacuum box 82.

In this invention the fiber flow from the release zone 74 to the forming surface 80 travels through an unconfined region, and the vacuum box 82 is longer than the vacuum box employed in the apparatus disclosed in the 715,165 application. This vacuum box includes two separate chamber 84 and 86 provided with separate conduits through which the cubic feet per minute (cfm) of air flow can be individually adjusted.

It has been found that pressurizing the working section 26 causes an increased volume of air flow that must be properly handled in the forming area in order to obtain good quality formation. By providing the unconfined region of fiber flow and employing the longer vacuum box, the web formation area can be increased to accommodate this increased gas flow, without creating an excessive pressure drop through the web as it is being formed.

As is schematically depicted in the drawing, the interior of each of the vacuum box chambers 84 and 86 is provided with a lattice structure consisting of a series of cross-machine-direction partitions 87 and a similar series of machine-direction partitions 89 (only one being shown) providing vertical passages to properly channel the flow of incoming air through the forming surface 80. This is desirable to prevent uncontrolled air flow which could create undesirable basis weight variations in the formed web structure.

The lower extent of the release zone 74 includes a downwardly extending partition 90 including a doffing member 92 at its upper end. This construction is identical to that of the back wall 98 and doffing member 102 disclosed in the 715,165 patent. As in the 715,165 application, the upper edge of the doffing member 92 is positioned extremely close to the periphery of the main drum 20 to intercept the air-fiber flow adjacent the periphery of said main drum to deflect said flow for subsequent deposition onto the forming surface 80.

Although the doffing member 92 is effective in intercepting and diverting air-fiber flow which is close to the periphery of the main drum 20, it is not effective in removing air that is trapped between the teeth of the drum. If this trapped air is directed to the inlet section 12 of the apparatus by rotation of said main drum, it will disturb the laminate fibrous feed 18. This disturbance causes nonuniform movement of the feed that results in basis weight nonuniformities in the formed fibrous structure. To prevent this from happening a lower seal arrangement 94 is provided between the rear partition 90 and the inlet section 12. This seal arrangement prevents textile-length fibers from remaining hooked on the projections of the main drum as the projections are moved past the doffing member 92, and also prevents the undesirable conveyance of air to the inlet section 12 of the apparatus.

The seal arrangement 94 includes a seal pad 96 and a nozzle 98 adjacent opposed ends of a lower housing wall 100. The nozzle 98 has an outlet oriented to direct a gas, preferably air, against the outer periphery of the main drum 20 with a force component in a direction opposed to the direction of rotation of the drum. The seal pad 96 is spaced from the nozzle in the direction of rotation of the drum, and is in engagement with the projections on the drum periphery. The seal pad creates a back pressure in the region of the main drum adjacent the nozzle to aid in doffing fibers from the teeth of said drum for subsequent conveyance to the forming surface 80. Directing a gas against the outer periphery of the main drum through the nozzle 98 removes air which is trapped between the teeth of said main drum to prevent that air from being conveyed to the inlet section of the apparatus.

The seal arrangement 94 is not a part of the instant invention; but rather is the joint invention of Joel P. Gotchel, Aris C. Spengos and Henry J. Norton, and is specifically described and claimed in U.S. patent application Ser. No. 715,138, filed on Aug. 17, 1976. For further details of the seal arrangement 94 reference can be had to this latter application, which is incorporated herein by reference.

In accordance with this invention the main drum 20 is rotated at a surface speed of at least 12,500 feet/minute. The various worker and turner rolls are rotated at a speed of from about 175 to 300 feet/minute, and preferably they are all rotated at the same speed. In a preferred construction the main drum 20 has a diameter of approximately 23.5 inches, and therefore, a surface speed of 12,500 feet/minute is equivalent to a rotational velocity of approximately 2,000 rpm. Most preferably the main drum is rotated at a speed in excess of 15,000 feet/-minute (greater than 2,500 rpm) to achieve the desired separation and blending of the fibers. In accordance with this invention applicants have satisfactorily formed air-lay fiber structures including 85%, by weight, wood pulp fibers, and 15%, by weight, 1-9/16, 1½ denier rayon fibers at a speed in excess of 400 feet per minute.

The working section should be pressurized to a positive pressure level sufficient to minimize undesirable air flow characteristics in the working section 16 to permit the proper separation and blending of the fibers in said working section. In the formation of fibrous webs less than 6 ounces/yards$^2$ at speeds in excess of 400 feet per minute it is desirable to pressurize the working section to at least 6 inches of water, and preferably to a level in excess of 10 inches of water, such as 16 inches of water. In accordance with this invention the working section has been pressurized to about 16 inches of water with an air flow of approximately 300 cfm per linear foot of machine width to form a low basis weight web less than 6 ounces/yard$^2$ at a speed in excess of 450 feet per minute. It should be understood that this invention can also be employed with advantage to form heavier basis weight mats up to about 50 ounces/yard$^2$.

Having described our invention we claim:

1. A carding method for forming a nonwoven fibrous structure including short fibers under ¼ inch in length and longer reinforcing fibers blended together, said short fibers being the predominate fiber component, by weight, in the structure; the method including the steps of:

rotating a main carding drum having projections on its outer periphery at a surface speed of at least about 12,500 feet/minute;

directing a fibrous feed into engagement with the rotating outer periphery of the main drum whereby rotation of the drum past the fibrous feed separates fibers from said feed, said fibrous feed including short fibers under ¼ inch in length and longer reinforcing fibers, said short fibers constituting the predominate fiber component, by weight, in said feed;

directing fibers separated from the fibrous feed into a working section including rotating satellite rolls positioned adjacent the main drum and having projections on their outer peripheries for cooperating with projections on the periphery of the main drum to individualize and blend together the fibers that are directed into the working section;

providing a housing over the working section that substantially isolates the working section from the environment around it so that pressure conditions within the working section can be independently controlled;

providing a source of pressurized air;

communicating said source of pressurized air with the interior of the housing for continuously maintaining a positive pressure in the working section at a level in excess of 2 inches of water to minimize undesirable air flow characteristics that adversely affect the individualizing and blending of the fibers in the working section;

conveying the individualized fibers through the pressurized working section to a release zone on the periphery of the main drum at which the individualized and blended fibers are released from the periphery of said main drum for subsequent conveyance to a foraminous forming surface upon which the fibrous structure is formed.

2. The method of claim 1 including sucking air through the foraminous forming surface by a vacuum source to aid in depositing the fibers on the foraminous forming surface.

3. The method of claim 2 including the steps of moving the foraminous forming surface at a speed in excess of 400 ft./minute as the fibers are deposited on the surface in the form of a nonwoven fibrous web having a basis weight of less than about 6 ounces/yard$^2$ and operating the pressurized air source for establishing a positive pressure in the working section of at least 6 inches of water as the fibers are individualized and blended together.

4. The method of claim 3 including operating the pressurized air source for establishing a positive pressure greater than 10 inches of water in the working section.

5. The method of claim 2 including the step of providing a plurality of sets of worker and turner satellite rolls about the periphery of the main carding drum, including an opening through a wall of the housing in a region between the most downstream set of worker and turner rolls and the exit from the working section and operating the pressurized air source for directing air under pressure through the opening for establishing and maintaining the positive pressure in the working section.

6. The method of claim 5 including moving the foraminous forming surface at a speed in excess of 400 ft./minute as the fibers are deposited on the surface in the form of a nonwoven fibrous web having a basis weight of less than about 6 ounces/yards$^2$ and operating the pressurized air source for directing the air through the opening for establishing a positive pressure of at least 6 inches of water in the working section.

7. The method of claim 6 including the step of rotating the main drum at a surface speed in excess of 15,000 feet/minute.

8. A carding method for forming a nonwoven fibrous structure including short fibers under ¼ inch in length and longer reinforcing fibers blended together, said short fibers being the predominate fiber component, by weight, in the structure; the method including the steps of:

rotating a main carding drum having projections on its outer periphery at a surface speed of at least about 12,500 feet/minute;

directing a fibrous feed into engagement with the rotating outer periphery of the main drum whereby rotation of the drum past the fibrous feed separates fibers from said feed, said fibrous feed including short fibers under ¼ inch in length and longer reinforcing fibers, said short fibers constituting the predominate fiber component, by weight, in said feed;

directing fibers separated from the fibrous feed through a working section by rotation of the main drum, said working section including adjacent sets of rotating satellite rolls, each set including a rotating worker roll and a rotating turner roll with projections on their outer peripheries, the worker roll of each set being positioned beyond its respective turner roll in the direction in which the main drum is rotating, the rolls in each set of satellite rolls being positioned close to each other and to the periphery of the main drum for cooperating with said main drum and with each other to individualize and blend the fibers directed through the working section;

conveying the individualized fibers from the working section to a release zone on the main drum where said fibers are released from the periphery thereof for conveyance to a foraminous forming surface upon which the fibrous structure is formed;

providing a housing about the working section;

separating adjacent sets of satellite rolls with a baffle member connected to interior walls of the housing to substantially isolate the action of the sets of satellite rolls that are separated by said baffles;

providing a passageway through a wall of the housing;

directing a gas under pressure through the passageway for establishing a positive pressure greater than 2 inches of water in the working section to minimize undesirable air flow characteristics about the sets of satellite rolls

9. The method of claim 8 including sucking air through the foraminous forming surface by a vacuum source to aid in depositing the fibers on the foraminous forming surface.

10. The method according to claim 9 including the steps of directing the gas through the passageway for establishing a positive pressure of at least 6 inches of water in the working section and depositing the fibers onto the foraminous forming surface in the form of a nonwoven fibrous web having a basis weight of less than about 6 ounces/yards$^2$ while moving the foraminous forming surface at a speed in excess of 400 feet/minute.

11. The method of claim 9 including the step of providing the passageway through the housing wall in a region between the exit from the working section and the worker roll of the set of satellite rolls closest to said exit.

12. The method of claim 10 including pressurizing the working section to a positive pressure in excess of 10 inches of water.

13. The method of claim 12 including the step of rotating the main carding drum at a surface speed in excess of 15,000 feet/minute.

* * * * *